US009790813B2

(12) United States Patent
Kraus et al.

(10) Patent No.: US 9,790,813 B2
(45) Date of Patent: Oct. 17, 2017

(54) TWIST PREVENTION FOR TURBOMACHINERY

(71) Applicant: MTU Aero Engines AG, Munich (DE)

(72) Inventors: Juergen Kraus, Karlsfeld (DE); Stephan Wintner, Munich (DE)

(73) Assignee: MTU Aero Engines AG, Munich (DE)

( * ) Notice: Subject to any disclaimer, the term of this patent is extended or adjusted under 35 U.S.C. 154(b) by 544 days.

(21) Appl. No.: 14/201,498

(22) Filed: Mar. 7, 2014

(65) Prior Publication Data

US 2014/0255183 A1 Sep. 11, 2014

(30) Foreign Application Priority Data

Mar. 7, 2013 (DE) ..... 10 2013 203 870

(51) Int. Cl.
*F01D 25/24* (2006.01)
*F01D 11/12* (2006.01)

(52) U.S. Cl.
CPC ..... *F01D 25/246* (2013.01); *F01D 11/122* (2013.01); *F05D 2240/11* (2013.01)

(58) Field of Classification Search
CPC .. F01D 25/246; F01D 17/162; F05D 2240/11; F05D 2250/75
See application file for complete search history.

(56) References Cited

U.S. PATENT DOCUMENTS 6,076,835 A * 6/2000 Ress ..... F16J 15/0887 277/637
7,063,503 B2 6/2006 Meisels
2009/0208338 A1* 8/2009 Major ..... F01D 11/001 416/215
2011/0044803 A1 2/2011 Di Paola et al.

FOREIGN PATENT DOCUMENTS

EP 2 093 380 A2 8/2009

OTHER PUBLICATIONS

German Examination Report dated May 9, 2014 (Four (4) pages).
German Examination Report dated Nov. 27, 2013 (Eight (8) pages).

* cited by examiner

*Primary Examiner* — Gregory Anderson
*Assistant Examiner* — Juan G Flores
(74) *Attorney, Agent, or Firm* — Crowell & Moring LLP

(57) ABSTRACT

A twist prevention system for turbomachinery is disclosed. The twist prevention system has a first ring segment pair with a first radially inner ring segment and a first radially outer ring segment and a second ring segment pair having a second radially inner ring segment and a second radially outer ring segment. The ring segment pairs have mutually facing faces. A portion of the face of the first radially inner ring segment overlaps a portion of the face of the second radially outer ring segment in the radial direction.

8 Claims, 1 Drawing Sheet

2'
340'
341'
H1
H2
342'
343'
3'
220'
221'
222'

110
111
112
2
21
320
3
32
30
31
22
220
221
340
34
341
342
4
343
40
33
222
100
100
100

TWIST PREVENTION FOR TURBOMACHINERY

This application claims the priority of German Patent Document No. DE 102013203870.4, filed Mar. 7, 2013, the disclosure of which is expressly incorporated by reference herein.

BACKGROUND AND SUMMARY OF THE INVENTION

The invention relates to a twist prevention system for turbomachinery.

A plurality of variously designed turbomachinery is already known from the prior art. The turbomachinery has a housing through which axial flow is possible, on which at least a guide wheel is fastened, which has a plurality of circumferentially arranged adjacent guide vanes. The guide vanes have, at their radially inner end, an end portion, which, in particular in gas turbines, can be connected with a seal carrier. The seal carrier is used for sealing a gap between the guide vane, in particular the end portion, and a rotor of the turbomachine.

Guide vanes, in particular those which can be adjusted about their longitudinal axis are, on their radial end, connected to an inner ring segment and end portion, in particular releasably so. In one embodiment, a radially inner end of the guide vane, such as, for example, a pin provided on a vane blade, can be accommodated in a bushing, which is fixed by the inner ring segment. The inner ring segment, in turn, is connected to a seal carrier segment, in particular releasably.

In particular in the operation of such gas turbines, the problem occurs that the inner ring segments can twist together, or the inner ring formed by them can twist with respect to the seal carrier segments and the seal carrier formed therefrom.

From designs from internal practice, versions are known in which a relative rotation between an inner ring segment and a seal carrier segment is prevented by a bolt connection. A bolt connection has the disadvantage that an additional process step in the form of manufacturing a hole is required in the inner ring segment and the seal carrier segment. Furthermore, the inner ring segment and the seal carrier segment must be designed so that sufficient space is available to receive the bolt, which is particularly a problem when the inner ring segment and the seal carrier segment have small dimensions.

Generally, this entails the need for an advantageous twist prevention system for the turbomachinery, in particular a twist prevention system between a segmented inner ring and a seal carrier of a gas turbine.

Therefore, a task of an embodiment of the present invention is to provide an improved twist prevention system for a turbomachine, particularly improved twist prevention between a segmented inner ring and a seal carrier of a gas turbine.

According to the invention, a twist prevention system for turbomachinery is provided, which comprises at least a first ring segment pair and a second ring segment pair. In one embodiment, the turbo machine has further first and/or second and/or additional ring segment pairs. In particular, an outer ring and an inner ring fixed thereto of a turbo machine can, according to the present invention, consist of a first ring segment and a pair or several pairs of the second ring segment, or a second ring segment pair and one or more pairs of the first ring segment. Similarly, an outer ring and an inner ring fixed thereto of a turbo machine, according to the present invention, can have two or more first and two more second segment pairs, in particular made therefrom, which in an embodiment can be alternately arranged in the circumferential direction.

The ring or the first segment pairs each comprise a first radially inner ring segment and a radially outer first ring segment. The one, or the second ring segment pairs, in each case have a second radially inner ring segment and a radially outer second ring segment.

In one embodiment of the present invention, the radially outer ring segment pairs can be the inner ring segment pairs of a gas turbine, and the radially inner ring segment pairs thereon, in particular releasably fastened, in particular form-fitting radially and/or axially fixed, can be the seal carrier segment pairs of the gas turbine. Accordingly, a twist prevention system between the inner ring and a segmented seal carrier of a gas turbine is a preferred application of the present invention, so that these will be explained in detail, in particular with reference thereto. The invention is not limited to such a twist prevention system, but generally relates to a twist prevention system between a segmented outer ring and an, in particular radially and/or axially fixed, inner ring of a turbomachine.

The ring segment pairs have mutually facing faces. According to the invention, it is provided that a portion of the face of the first radially inner ring segment covers a portion of the face of the second radially outer ring segment in the radial direction.

By such radial overlap of the first radially inner ring segment and the second radially outer ring segment, twisting of the first radially inner ring segment is, in one embodiment, limited in a form-fitting manner relative to the first radially outer ring segment, and is, in particular, at least substantially-prevented. In particular, twisting can be limited or prevented, in that a movement is prevented, for example, of the first radially inner ring segment, since the portion of the face of the first radially inner ring segment is in a form-fit connection with the portion of the face of the second radially outer ring segment.

Thus, in contrast to known designs, no bolted connections are necessary any longer to prevent relative twisting between the first radially inner and first radially outer ring segments of the first ring segment pair and/or between the second radially inner and second radially outer ring segments of the second ring segment pair. In one embodiment, a separate work step for making the holes for the bolt connection in the ring segments can be dispensed with, which also can reduce the manufacturing cost of the twist prevention system. Additionally or alternatively, relative twisting of the ring segments to each other, in which the inner and outer ring segments of the ring segment pairs are small in size, can be prevented.

The faces of a ring segment are understood to mean the two end sides of a ring segment which restrict it in the circumferential direction. The faces extend transversely, in particular perpendicularly, in the circumferential direction.

In one embodiment, a distance of a radially outer contact surface of the first and/or second radially inner ring segment and a radially inner mating contact surface of the first and/or second radially outer ring segment from a central axis of the turbomachine in the circumferential and/or axial direction, can, at least substantially, remain constant. Such a configuration of the inner and outer ring segments offer the advantage that they can be manufactured in a simple manner, thereby reducing manufacturing costs. A contact surface of the first and/or second radially inner ring segment and mating contact surface of the first and/or second radially outer ring segment and in particular the surfaces of the first and/or second radially inner ring segment and the first and/or second radially outer ring segment are described, which in the assembled state of the twist prevention system or the turbo machine are in contact with each other.

The twist prevention system, as described above, comprises a plurality of ring segment pairs. In a twist prevention system, in which more than two ring segment pairs are present, in addition to the first and second ring segment pairs, at least a third ring segment pair may be present. The third ring segment pair may be located adjacent to the first or the second ring segment pair. Furthermore, the third ring segment pair can comprise a third radially inner ring segment and a third radially outer ring segment. A portion of the face of the third radially inner ring segment of the third ring segment may overlap a portion of the face of the first or second radially outer ring segment in the radial direction. By providing the third ring segment pair, a relative twisting between the radially inner and the radially outer ring segments of the respective ring segment pairs can be further prevented. In an alternative embodiment, the third ring segment pair is formed such that a portion of the face of the third radially inner ring segment does not overlap the portion of the face of the first and second radially outer ring segment. Thus, by a radial shoulder between said first and second ring segment pairs, a twisting of the third or further ring segment pairs, or the inner relative to the outer ring, is, in particular, prevented.

In one embodiment, the twist prevention system can be formed in such a way that all the circumferentially adjacent ring segment pairs are each formed in such a way that a portion of the face of a radially inner segment of a ring segment pair overlaps a portion of the face of a radially outer segment of an adjacent ring segment pair in the radial direction. With such a design of twisting prevention system, relative twisting can be particularly effectively limited or prevented.

In the twist prevention system, the distance of a radially inner lateral surface of the first radially inner ring segment and a radially inner lateral surface of the second radially inner ring segment and/or the distance between a radially outer lateral surface of the first radially outer ring segment and a radially outer lateral surface of the second radially outer ring segment, to the central axis of the turbomachine, at the mutually facing faces, can be equal, so that the lateral surfaces, at least substantially, steplessly enter into one another.

In a preferred embodiment, the first and/or second and/or third radially inner ring segment can be a seal carrier segment. Furthermore, the first and/or second and/or third radially outer ring segment may also be an inner ring segment. The inner ring segment may be coupled with one or more guide vanes, and in particular be connected fixedly or movably and/or permanently or releasably. Additionally or alternatively, the inner ring segment can be connected with the seal carrier segment, in particular releasably.

The seal carrier segment and the inner ring segment can be connected together either releasably with a form-fit connection, in particular axially and/or radially fixed to one another. In particular, for establishing the connection between the seal carrier segment and the inner ring segment, a projection into a recess can be used. The projection may be disposed at one of the inner ring segment and the seal carrier segment. Accordingly, the receptacle can be arranged on the other of the inner ring segment and the seal carrier segment.

The connection between the inner ring segment and the seal carrier segment can be arranged in adjacent ring segment pairs offset from each other in the radial direction. Thus, the projection and the wall portions bounding the receptacle in the adjacent ring segment pairs can be arranged offset from each other in the radial direction. In particular, the projection and the receptacle or the receptacle-wall-defining portions of the first ring segment pair in the radial direction may be arranged closer to or farther from the central axis of the turbomachine than the projection and the receptacle or the receptacle-wall-defining portions of the second ring segment pair.

A seal may be provided between the inner ring segment and the seal carrier segment. The seal may be formed with a w-shaped profile. The seal may further be arranged in a cavity defined by the inner ring segment and the seal carrier segment. The provision of the seal has the advantage that a leakage current can be reduced, thereby improving the efficiency of the turbomachine. Here, a leakage current is possible, as, in the above-mentioned connection between the inner ring segment and the seal carrier segment, the projection and the receptacle are shaped so that a small gap exists between them, through which the leakage current can flow.

The seal can be arranged in a radial direction closer to the central axis of the turbomachine than the connection between the inner ring segment and the seal carrier segment.

The cavity, and the wall portions of the inner ring segment and/or the seal carrier segment bounding the cavity for accommodating the seal, can be arranged offset from each other in adjacent ring segment pairs in the radial direction. In particular, the cavity and the wall portions of the inner ring segment and the seal carrier segment of the first ring segment pair in the radial direction may be arranged closer to or farther from the central axis of the turbomachine than the wall portions of the inner ring segment and the seal carrier segment of the second ring segment pair.

The twist preventing system described above can be used in a gas turbine, in particular an aircraft engine having at least one compressor and/or turbine stage. However, the use of the twist prevention system is not limited to the gas turbine and aircraft engine, but can also be used in other turbomachinery.

Further features and advantages will become apparent from the exemplary embodiment and the drawings.

DETAILED DESCRIPTION OF THE DRAWINGS

Figures 1, 2:
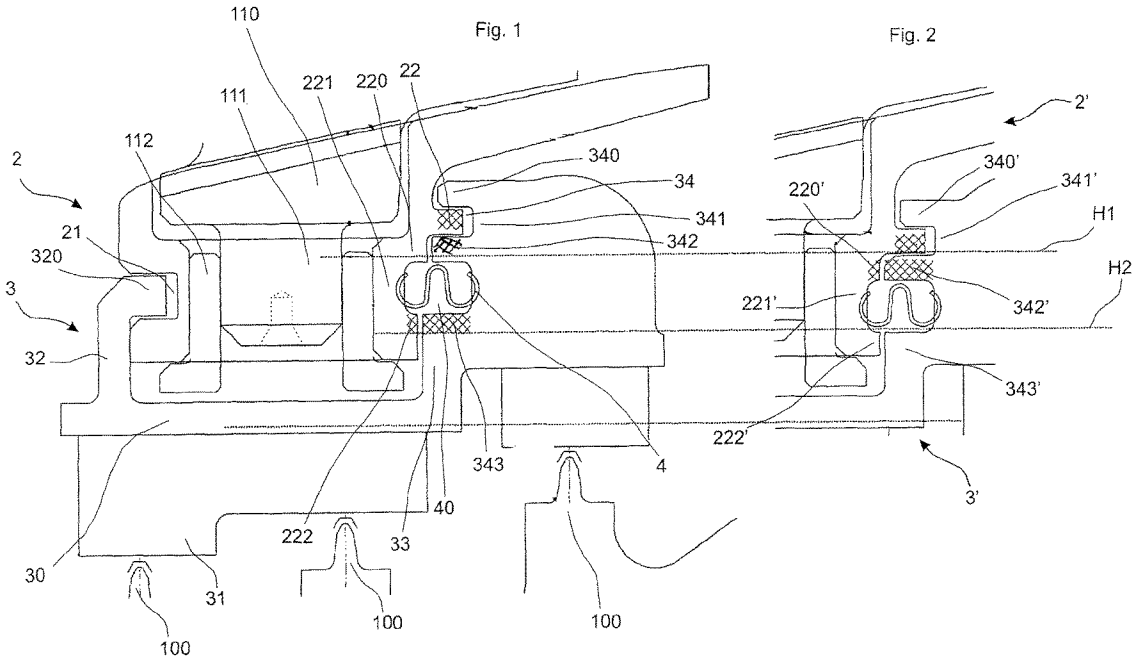
FIG. 1 illustrates a view of a face of a first ring segment pair of a turbomachine.
FIG. 2 is a view of a face of an adjacent second ring segment pair to the first ring segment pair of FIG. 1 in the circumferential direction.

A turbo machine, otherwise not shown, has a plurality of impellers and guide wheels arranged offset from each other in the axial direction of the turbomachine. The guide wheels are arranged along the axial direction of the turbomachine between two impellers, and have a plurality of vanes 110 in the circumferential direction.

The guide vanes 110 shown in FIGS. 1 and 2 are those which are adjustable around their longitudinal axis. In this case, each guide vane 110 includes a blade on which has a pin 111 at the radially inner end. The pin 111, as shown in FIG. 1, is mounted in a bushing 112.

In FIG. 1, a first ring segment pair is shown, having a first inner ring segment 2 comprising an inner ring of the impeller and a first seal carrier segment 3 of a seal carrier of this guide wheel. The inner ring segment 2 of a not-shown center axis of the turbomachine (horizontal in FIG. 1) is farther away than the first seal carrier segment 3 and serves to fix the bushing 112.

The inner ring has a plurality of circumferentially arranged adjacent inner ring segments 2, 2'. The first inner ring segment 2 is designed so that it is coupled with at least one guide vane 110. Further, the first inner ring segment 2 is releasably connected to the, in particular trough-shaped, first seal carrier segment 3 of the seal carrier.

The seal carrier has a plurality of circumferentially arranged adjacent seal carrier segments 3, 3'. The first seal segment carrier 3 carries a sealing material 31, preferably a honeycomb seal, which extends from a floor 30 of the seal carrier material in a direction away from the first inner ring segment 2. The sealing material 31 is in contact with another sealing material 100 attached to a rotor of the turbomachine. By means of the sealing material 31 attached to the first seal carrier segment 3 and the sealing material 100 attached to the rotor, a gap between the guide wheel, in particular the first inner ring segment 2, and the rotor, is sealed, so that no undesirable leakage can flow through it.

From the floor 30 of the first seal carrier segment 3, two flanks 32, 33 extend in the radial direction. A first flank 32 of the floor 30 has at its distal end a connection means in the form of a seal carrier projection 320, which transversely, in particular perpendicularly, extends from the first flank 32. The seal carrier protrusion 320 extends in such a way that it, for producing a form-fit connection between the first seal carrier segment 3 and the first inner ring segment 2, protrudes into an inner ring receptacle 21 of the first inner ring segment 2 and this fixes these axially and radially with respect to each other.

A second flank 33 has, on its end that is removed from the floor 30, a seal carrier receptacle 34. The seal carrier receptacle 34 is bounded by an upper wall portion 340, a side wall portion 341 and a central wall portion 342. The upper wall portion 341 is further away in a radial direction from the central axis of the turbomachine than the central wall portion 342. The side wall portion 341 connects the upper with the middle wall section 340, 342. To produce a form-fit connection between the first inner segment 2 and the first seal carrier segment 3, an inner ring protrusion 22 extends into the seal carrier receptacle 34, in order to set these radially and axially with respect to each other. The inner ring segment projection 22 extends, in particular analogously to the seal carrier protrusion 320, at least substantially parallel to the central axis of the turbomachine.

Further, a cavity 40 is formed between the first seal carrier segment 3 and the first inner ring segment 2, in which a seal 4 is arranged. The seal 4 is formed to have a w-shaped profile. The cavity 40, in the radial direction, in particular along a radial line, is located closer to the central axis of the turbomachine than the seal carrier receptacle 34. The seal 4 is supported on a wall portion of the first seal carrier segment 3 and the first inner ring segment 2.

The cavity 40 is bounded by the center wall portion 342, a lower wall portion 343, and a wall portion of the seal carrier segment 3 connecting the two wall portions. The central wall portion 342 is arranged further away in a radial direction from the central axis of the turbomachine than the lower wall portion 343. Further, the cavity 40 is bounded by an upper wall portion 220, a lower wall portion 222 and a center wall portion 221 that connects the upper and lower wall portions 220, 222 with each other, of the first inner ring segment 2.

In FIG. 2, a second ring segment pair is shown, which is arranged circumferentially adjacent to the first ring segment pair shown in FIG. 1. The second ring segment pair includes a second inner ring segment 2' and a second seal carrier segment 3'. The second inner ring segment 2' is arranged adjacent to the first inner ring segment 2 in the circumferential direction of the segment. The second seal segment carrier 3' is arranged circumferentially adjacent to the first seal carrier segment 3. The second ring segment pair is constructed substantially identical to the first ring segment pair shown in FIG. 1. Below we will therefore focus only on the differences between the first and second ring segment pairs.

The second ring segment pair, shown in FIG. 2, is partially offset in the radial direction from the first ring segment pair shown in FIG. 1. Thus, as shown in FIG. 2, the inner ring segment projection 22 of the second inner ring segment 2' and the upper, side, and central wall portions 340', 341', 342' of the second seal carrier segment 3' are, in the radial direction, located closer to the central axis of the turbomachine than the first ring segment pair shown in FIG. 1. This is evident by comparison of the radial position of the sections mentioned above with respect to a first horizontal line marked H1.

Further, in the second ring segment pair, the lower wall portion 343' of the second seal carrier segment 3' and the lower wall portion 222' of the second inner ring segment 2' are formed in such a manner that, in comparison to the lower wall portion of the first seal carrier segment and the first inner ring segment shown in FIG. 1, in the radial direction, these are also arranged closer to the central axis of the turbomachine. This is evident by comparison of the radial position of the sections mentioned above with respect to a second drawn horizontal line H2.

Thus, a portion 342 of the face of the first radially inner ring segment 3 (above the line H1 in FIGS. 1, 2) overlaps a portion of the face of the second radially outer ring segment 2' in the radial direction and prevents a twisting of the first radially inner ring segment 3 under the second radially outer ring segment 2', and vice versa, and thus a twisting of the seal carrier relative to the inner ring, to which it is fixed axially and radially in form-fit manner by the projections 320 and 22.

The seal carrier and the inner ring are, except for the above-described differences, in particular radial shoulders or overlaps, symmetrical in their rotation, whereby the breaking of the twisting symmetry of the radial overlaps of the faces of adjacent segment pairs limits or prevents relative twisting in the circumferential direction. Correspondingly, the contact surfaces of the seal carrier and the inner ring, at least substantially, have the form of a cylindrical jacket, so that the distance between a radially outer contact surface of the first and/or second inner ring segments 2, 2', for example, the radially inner surface of the inner ring projection 22, and a radially inner counter-contact surface, for example, the radially inner surface of the seal carrier receptacle 34, from a central axis in the circumferential direction (perpendicular to FIG. 1, 2) and in the axial direction (horizontal in FIG. 1, 2), is constant.

It can also be seen in comparing FIGS. 1, 2 that the distance between a radially inner surface of the first radially inner ring segment 3 and a radially inner surface of the second radially inner ring segment 3' of the mutually facing faces is the same: in the sectional views of FIGS. 1, 2, which show these mutually facing faces, the radially inner surfaces are equidistant from a dotted auxiliary line.

REFERENCE LIST

2 first inner ring segment
2' second inner ring segment
3 first seal carrier segment
3' second seal carrier segment
4 w-shaped seal
21 inner ring receptacle
22 inner ring projection
30 floor
31 sealing material
32 first flank
33 second flank
34 seal carrier receptacle
100 sealing material
110 guide vane
111 pin
112 bushing
220 upper wall portion of the first inner ring segment
220' upper wall portion of the second inner ring segment
221 center wall portion of the first inner ring segment
221' center wall portion of the second inner ring segment
222 lower wall portion of the first inner ring segment
222' lower wall portion of the second inner ring segment
320 seal carrier projection
340 upper wall portion of the first seal carrier segment
340' upper wall portion of the second seal carrier segment
341 side wall portion of the first seal carrier segment
341' side wall portion of the second seal carrier segment
342 central wall portion of the first seal carrier segment
342' central wall portion of the second seal carrier segment
343 lower wall portion of the first seal carrier segment
343' lower wall portion of the second seal carrier segment
H1 first horizontal line
H2 second horizontal line The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A twist prevention system for a turbomachine, comprising:

a first ring segment pair with a first radially inner ring segment and a first radially outer ring segment; and a second ring segment pair with a second radially inner ring segment and a second radially outer ring segment;

wherein the second ring segment pair is offset in a radial direction from the first ring segment pair such that the first radially inner ring segment of the first ring segment pair is at a same radial distance from a central axis of the turbomachine as the second radially outer ring segment of the second ring segment pair.

2. The twist prevention system according to claim 1, wherein a distance of a surface of the first and the second radially inner ring segment and a surface of the first and the second radially outer ring segment from the central axis of the turbomachine in a circumferential and an axial direction is substantially constant.

3. The twist prevention system according to claim 1, further comprising a third ring segment pair with a third radially inner ring segment and a third radially outer ring segment, wherein a portion of a face of the third radially inner ring segment overlaps a portion of the face of the first or the second radially outer ring segment in the radial direction.

4. The twist prevention system according claim 1, wherein the first and the second radially inner ring segments are each a seal carrier segment and wherein the first and the second radially outer ring segments are each an inner ring segment which are coupled with a respective guide vane.

5. The twist prevention system according to claim 4, further comprising a first seal disposed between the first inner ring segment and the first seal carrier segment and a second seal disposed between the second inner ring segment and the second seal carrier segment.

6. The twist prevention system according to claim 5, wherein the first and the second seals have a w-shaped profile.

7. A gas turbine, comprising:

a compressor and/or turbine stage with a twist prevention system according to claim 1.

8. The gas turbine according to claim 7, wherein the gas turbine is an aircraft engine.

* * * * *